United States Patent [19]

Masuyama

[11] 4,098,068

[45] Jul. 4, 1978

[54] CUCKOO CLOCK

[76] Inventor: Isao Masuyama, 5075, Ohaza Ishioka, Ishioka-shi, Ibaragi-ken, Japan

[21] Appl. No.: 777,406

[22] Filed: Mar. 14, 1977

[30] Foreign Application Priority Data

Mar. 23, 1976 [JP] Japan ..... 51/30810

[51] Int. Cl.[2] ..... G04B 21/08; G04B 37/00

[52] U.S. Cl. ..... 58/12; 58/53

[58] Field of Search ..... 58/2, 12–14, 58/53–55, 152 R, 152 A, 152 B

[56] References Cited

U.S. PATENT DOCUMENTS

| | | | |
|---|---|---|---|
| 1,041,177 | 10/1912 | Schmidt | 58/12 |
| 2,054,677 | 9/1936 | Lux | 58/12 |
| 2,097,818 | 11/1937 | Krakowski | 58/16 |
| 3,918,249 | 11/1975 | Masuyama | 58/12 |

*Primary Examiner*—Edith S. Jackmon

[57] ABSTRACT

In a cuckoo clock including a timing mechanism and a whistle means for tolling a time, a bird-displaying mechanism comprises- a clock housing having an aperture in the front wall thereof; door means pivotally mounted on the front wall adjacent the aperture; a bird movable into and out of the aperture and having movable wings; plate means pivotally supporting the bird; guiding means having a guiding base slidably supporting the plate means; driving means for driving the guiding means; control means for controlling the driving means in time to a tolling signal from the timing mechanism; spreading means including a rotation lever pivotally mounted on the plate means for spreading the wings when the plate means travels along the guiding base by a predetermined distance in response to the tolling signal.

8 Claims, 8 Drawing Figures

CUCKOO CLOCK

BACKGROUND OF THE INVENTION

This invention relates to cuckoo clocks, particularly to improvement in behavior of birds of the cuckoo clocks.

In conventional cuckoo clocks, when the clock tolls a time, the head and face of a bird appears in an aperture provided in a cover plate of the housing of the clock, with the major portion of the body of the bird being positioned hidden inside the casing of the clock. It has been proposed that in order to give a more vivid impression to a viewer, a bird fully comes out of the housing of a cuckoo clock when the clock tolls a time (see U.S. Pat. No. 3,918,249, Masuyama, Nov. 11, 1975). However, there is an increasing demand of a cuckoo clock to provide greater reality to the cuckoo clock as well as providing a greater attractive quality to the clock itself.

SUMMARY OF THE INVENTION

Accordingly, one of the objects of this invention is to provide a cuckoo clock which enables a bird fully come out of the housing when the clock tolls a time to spread the wings for providing greater reality to the cuckoo clock.

Another object of this invention is to provide a cuckoo clock which enables a bird spreading the wings to flap the wings in time to the whistle of the cuckoo clock for providing a greater attractive quality to the cuckoo clock.

According to the present invention, there is provided a bird-displaying mechanism for a cuckoo clock including a timing mechanism and a whistle means for tolling a time, which comprises:

a clock housing having an aperture in the front wall thereof;

door means pivotally mounted on the front wall adjacent the aperture; a bird movable into and out of the aperture and having movable wings; plate means pivotally supporting the bird; guiding means having a guiding base slidably supporting the plate means; driving means for driving the guiding means; control means for controlling the driving means in time to a tolling signal from the timing mechanism; spreading means including a rotation lever pivotally mounted on the plate means for spreading the wings when the plate means travels along the guiding base by a predetermined distance in response to the tolling signal.

Other objects and features of the invention will be apparent from the following description.

BRIEF DESCRIPTION OF THE DRAWINGS

The accompanying drawings illustrate a preferred embodiment of the bird-displaying mechanism according to the present invention, wherein.

DESCRIPTION OF THE PREFERRED EMBODIMENT

Figure 1:
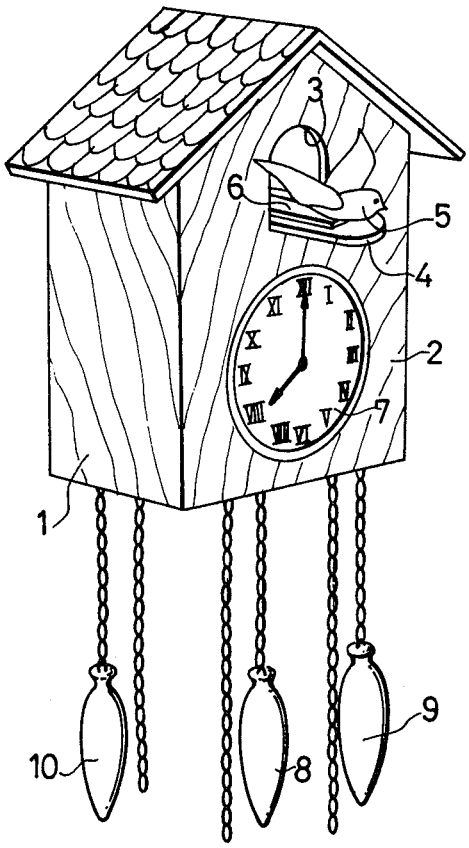
FIG. 1 is a perspective view of a cuckoo clock incorporating the bird-displaying mechanism embodying the present invention.

Referring to FIG. 1, reference numeral 1 generally represents a casing which houses therein a clock mechanism, and also includes a frontal cover plate 2, a window aperture 3 in the cover plate 2, a window 4, a bird 5, a perch plate 6 onto which the bird 5 is attached and a clock dial plate 7. Reference character 8 designates a first weight for actuating the hands of the clock. Reference character 9 designates a second weight for sounding a whistle at tolling time and reference character 10 represents a third weight for causing the bird 5 to move in and out of the casing 1. An electric motor may be used for the weight 10 which is used for decoration purpose. A single weight may be used for the weights 9 and 10 for simplicity.

Figure 2:
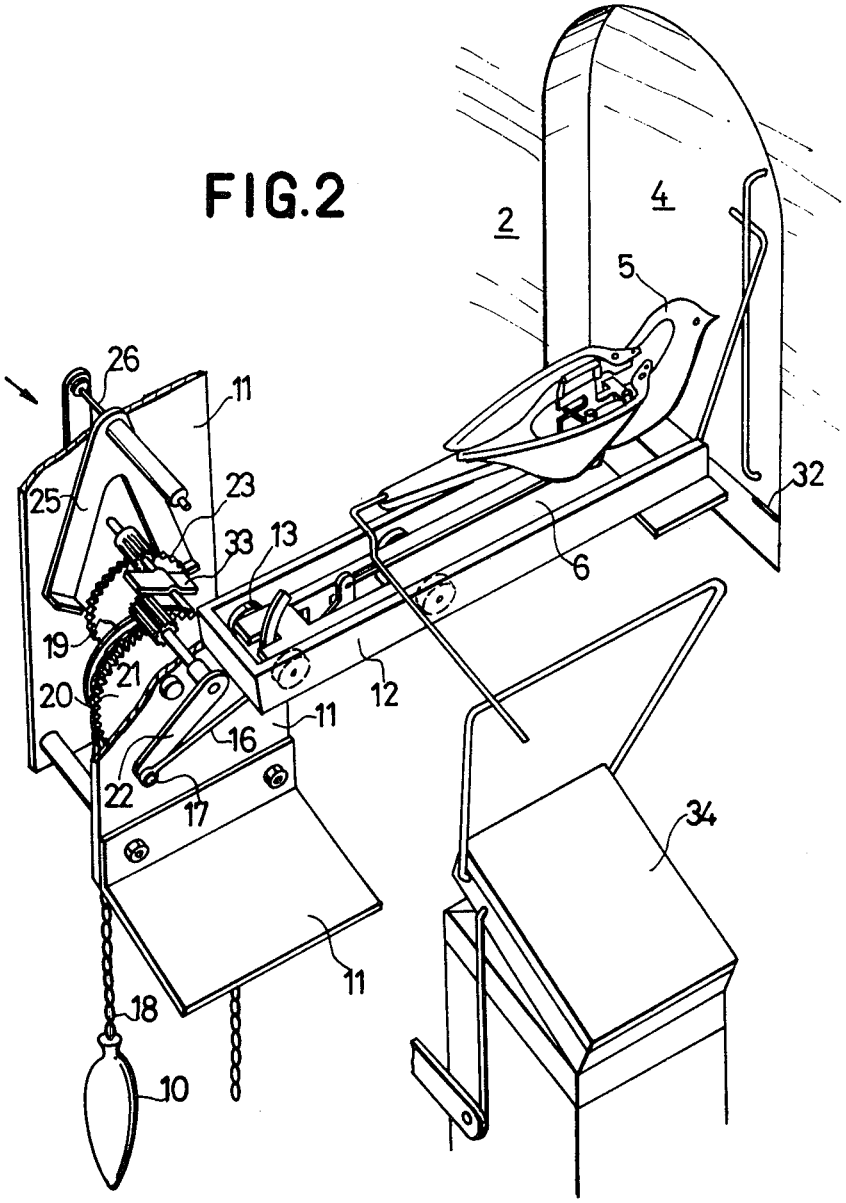
FIG. 2 a perspective view of the bird-displaying mechanism of the invention, particularly showing the driving mechanism, the guiding mechanism and the whistle means thereof.

In FIG. 2, a frame 11 is secured to the casing 1 to which a guiding base 12 is attached. Four rollers 13 are pivoted to the perch plate 6 so that it may slide along the guiding base 13. One end of a connecting rod 16 is pivotally mounted on a rotation lever 14 which is pivoted to the perch plate 6 as described hereinafter. The other end of the connecting rod 16 is pivotally mounted on a crank pin 17 which is provided at the free end of a crank arm 22. The weight 10 for driving the bird 5 to come out of the aperture 3 and to flap the wings is connected to a chain 18 which is trained about a chain wheel 19 journaled in the frame 11. Rigidly mounted on the shaft of the chain wheel 19 is a large gear 20 which is in meshing relation with a small gear 21. One end of the shaft of the small gear 21 is mounted on the crank arm 22 and the other end of the shaft is secured to a intermediate gear 23. A spring hinge 32 is always urging the door 4 to rotate toward a closed position. A governer 33 is provided for controlling the rotation of the intermediate gear 23. A bellows 34 serves for sounding a whistle.

Figure 3:
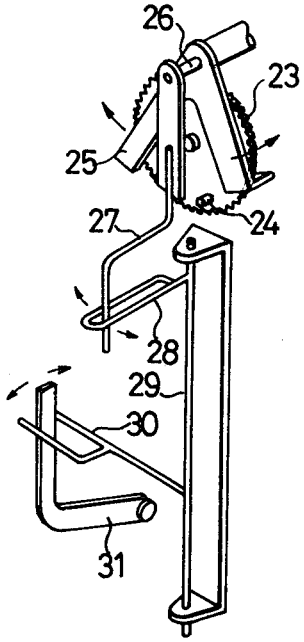
FIG. 3 is a perspective view of the control mechanism incorporated in the bird-displaying mechanism, as viewed in the direction of the arrow in FIG. 2 with portions removed for clarity.

Referring to FIG. 3, a pin 24 is attached to the reverse side of the intermediate gear 23. An inverted, generally V-shaped bracket 25 is rotatably mounted on the frame 11 in a manner such that a free end of the forked ankle bracket 25 comes to bear against the pin 24. The position of the bracket 25 with respect to the intermediate gear 23 is such that opposite ends of the forked bracket 25 are positioned in diametrically opposite points relative to the intermediate gear 23. A Z-shaped lever 27 is mounted on a shaft 26 of the bracket 25, and has a free end engaging an L-shaped rocker arm component 31 by way of a channel member 28, a vertical shaft 29 and a forked lever 30. The L-shaped rocker arm component 31 is adapted to be actuated by means of a clock mechanism (not shown), at a given time, for example, at 1 o'clock, 2 o'clock or 3 o'clock or every 30 minutes.

Figure 4:
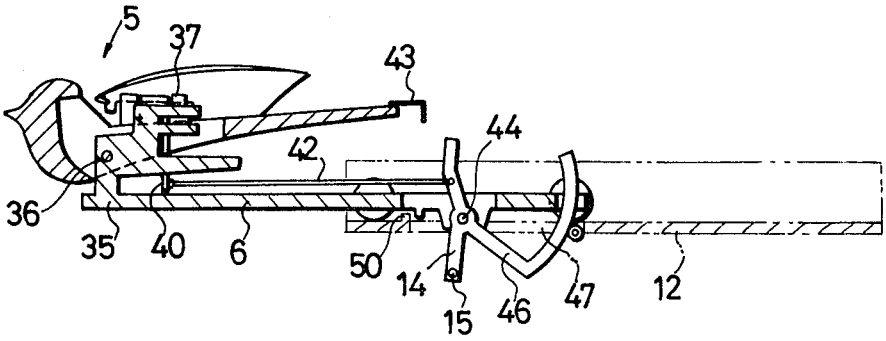
FIG. 4 is a sectional view of the spreading mechanism and the flapping mechanism incorporated in the bird-displaying mechanism as shown in FIG. 2.
Figure 5:
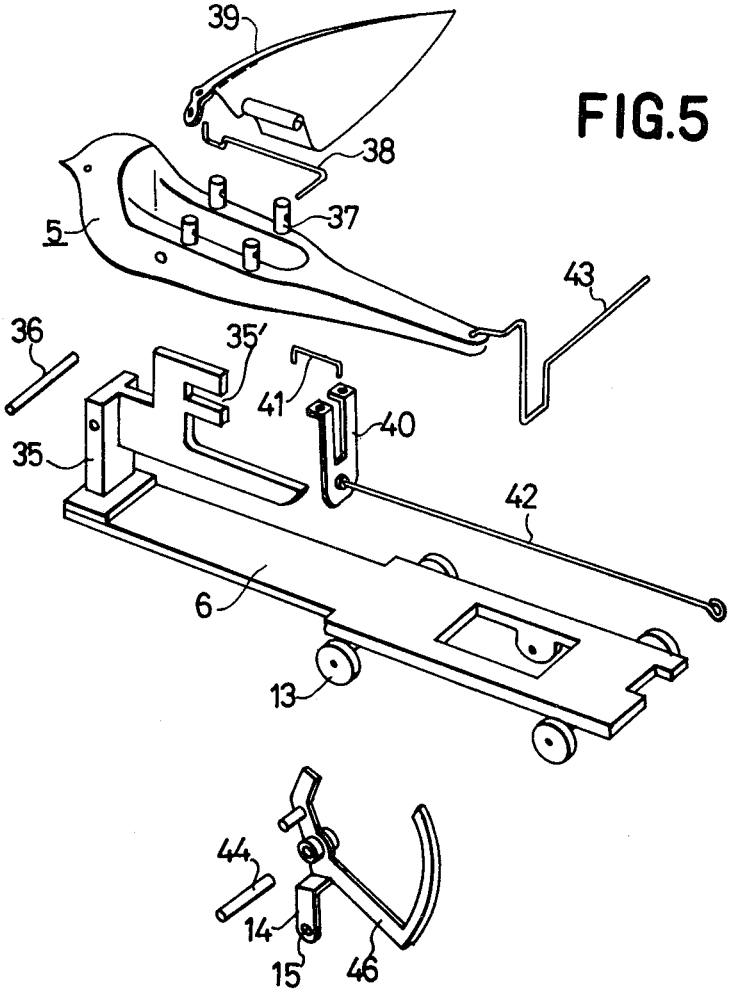
FIG. 5 is an exploded view of the spreading mechanism and the flapping mechanism as shown in FIG. 4.

Referring to FIGS. 4 and 5, there are shown the spreading mechanism and the flapping mechanism according to the invention. The bird 5 is pivotably mounted on a leg portion 35 provided on the end surface of the perch plate 6 with a shaft 36. A wire 38 is fitted through a pair of projections 37 provided on the bird 5, the front end of which rotatably mounted on the tip of the wings 39 and the rear end of which is bent into a recess 35' cut at the rear end of the leg portion 35. The center portion of the wings 39 is made of flexible paper or the like a portion of which is rolled around the wire 38 so that the bird 5 may flap the wings 39 as described hereinafter. A slider member 40 is mounted within the hole of the bird 5 for sliding along the rear portion of the leg portion 35. The slider member 40 is connected at the upper end thereof to the tip of the wings 39 through a linking wire 41 and at the rear surface to one end of a straight rod 42, the other end of which is rotatably mounted on the upper portion of the rotation lever 14. A wire 43 is fixed at one end to the tail of the birdd 5 with the other end projecting laterally. The rotation lever 14 is pivoted to the perch plate 6 with a shaft 44 with its lower end being rotably connected at a hole 15 to the connecting rod 16 for sliding movement. The rotation lever 14 has an antirotation arm 46 which prevents the lever 14 from rotating until the perch plate 6 travels beyond a predetermined distance.

The operation of the bird-displaying mechanism will now be described. It is assumed that the bird 5 is initially positioned inside the casing 1 and the window 4 is kept closed by the spring 32, as shown in FIG. 2. In FIG. 3, at the preselected tolling time, usually on the hour, the rocker arm component 31 is actuated by the clock mechanism (not shown). The movement of rocker arm component 31 causes the bracket 25 to move by way of the forked lever 30, the vertical shaft 29, the channel member 28, the Z-shaped lever 27 and the shaft 26. Thus, the pin 24 is released from engagement with the end of bracket 25. As shown in FIG. 2, the weight 10 acts on the intermediate gear 23 by way of the chain wheel 19, the gear 20, and the pinion gear 21 to turn the same. The weight 9 may be used for both sounding the whistle and turning the intermediate gear 23. An electronic motor may be used for these purposes while these weights serve as a decoration.

Accordingly, when the pin 24 provided on the intermediate gear 23 is disengaged from the end of the bracket 25, the intermediate gear 23 is caused to rotate substantially through 180°, and when the pin 24 on the intermediate gear 23 engages the other end of the bracket 25, the rotation of the intermediate gear 23 is stopped. During the above movement, the crank arm 22 completes a rotation through 180°. Thus, the perching plate 6 is urged outwardly of the aperture 3 due to the connecting rod 16, thereby forcing the window 4 downwardly, whereby the bird 5 attached to the perching plate 6 is fully exposed and is positioned substantially completely outside of the frontal cover plate 2.

In FIG. 4, when the rotation lever 14 is urged to travel forward such a distance that the anti-rotation arm 46 reaches an opening 47, and the perch plate 6 is stopped by a pin 50 provided on the guiding base 12, the rotation lever 14 is permitted to turn around the shaft 44 thereby pulling backward the slider member 40 leading to spreading the wings 39.

Figure 6A:
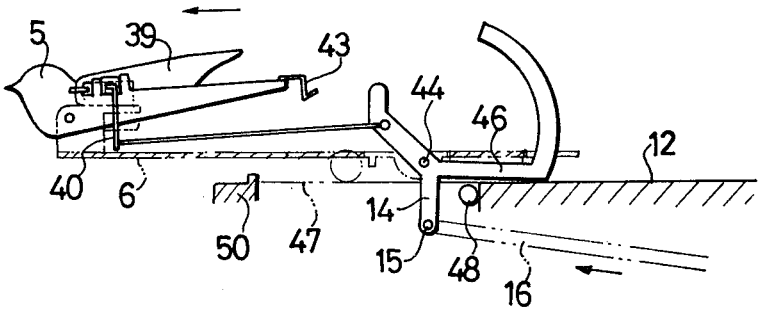
FIG. 6A, 6B and 6C are a schematic sectional view of the bird-displaying mechanism showing its operation.
Figure 6B:
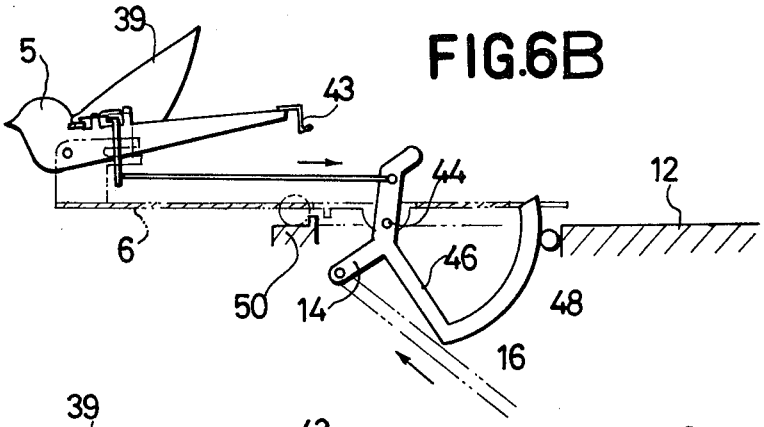
Figure 6C:
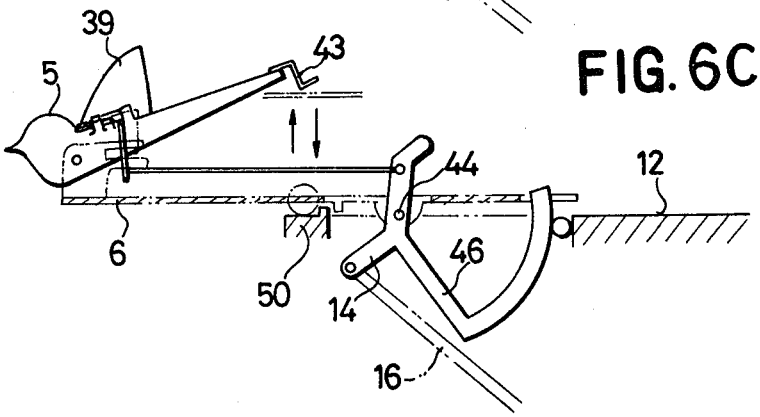

FIGS. 6A, 6B and 6C illustrate the operation of the spread and flapping mechanisms. In FIG. 6(A), the rotation lever 14 is pushed forward by the connecting rod 16 without rotation due to the anti-rotation arm 46 so that the bird 5 is permitted to proceed but not spread out the wings 39. In FIG. 6(B), when the anti-rotation arm 46 reaches the opening 47 of the guiding base 12, the bird 5 is stopped proceeding but permitted to spread the wings 39 by rotation of the rotation lever 14 in contact with the roller 50 provided at the edge of the opening 47. In FIG. 6(C), when the wire 43 fixed to the tail of the bird 5 is moved up and down by movement of the bellows 34, the bird 5 bows in time to sounding the whistle, which causes flapping the wings 39 since the rear end of the wire 38 fits in the recess 35' of the leg portion 35.

Upon completion of the time announcement, the rocker arm component 31 is again actuated to move the bracket 25, whereby the pin 24 is released from the other end of bracket 25 and the crank arm 22 rotates nearly through 180°.

The rotational movement is transmitted to the connecting rod 16, whereby the connecting rod 16 is actuated to retract the lower end of the rotation lever 14. When the anti-rotation arm 46 of the rotation lever 14 returns to a position on the guiding base 12, the wings 39 are folded and closed. The further backward movement of the rotation lever 14 retracts the perching plate 6 from the aperture 3, and then the window 4 is closed under the action of the spring 32. Thus, one cycle of advancing and retracting movement of the bird 5 is completed.

As is apparent from the foregoing, according to the present invention, the bird-displacing mechanism is provided with a perching plate 6 for the bird 5, a guiding base 12, a connecting rod 16, a crank pin 17 and a crank arm 22, in combination. Although the cuckoo clock of the present invention is so arranged that when the bird 5 is exposed from the aperture 3, the whistle 34 is sounded for tolling a time, no description is given as to the operation of the whistle 34, because it has no direct relation to the present invention. The present invention utilizes a crank mechanism to cause the bird to advance in or retract from the aperture. However, such mechanism for displacing the bird is not to be understood as limitative to the crank mechanism, since one may avail himself of equivalent mechanisms, such as pantograph mechanism, a rack and pinion mechanism, a spiral screw mechanism and the like.

What is claimed is:

1. In a cuckoo clock including a clock mechanism and a whistle means for tolling a time, a bird-displaying mechanism comprising:

a clock housing having an aperture in the front wall thereof;

door means pivotally mounted on said front wall adjacent said aperture;

a bird movable into and out of said aperture and having movable wings;

plate means pivotally supporting said bird;

guiding means having a guiding base slidably supporting said plate means;

driving means for driving said guiding means;

control means for controlling said driving means in time to a tolling signal from said clock mechanism;

spreading means including a rotation lever pivotally mounted on said plate means for spreading said wings when said plate means travels along said guiding base by a predetermined distance in response to said tolling signal.

2. A bird-displaying mechanism as claimed in claim 1 wherein said driving means includes at least one weight utilizing the gravity.

3. A bird-displaying mechanism as claimed in claim 1 wherein said driving means includes an electric motor.

4. A bird-displaying mechanism as claimed in claim 1 wherein said rotation lever has an anti-rotation arm for preventing rotation of said rotation lever until said plate means travels by a predetermined distance.

5. A bird-displaying mechanism as claimed in claim 1 wherein said guiding base has an opening a predetermined distance from one end thereof.

6. A bird-displaying mechanism as claimed in claim 5 wherein said guiding base has a roller pivotally mounted on the edge of said opening.

7. A bird-displaying mechanism as claimed in claim 1 wherein at least the central portions of said wings are made of paper.

8. A bird-displaying mechanism as claimed in claim 1 which further comprises flapping means attached at one end to the tail of said bird and engaging at the other end thereof a bellow member of said whistle means for flapping said wings in time to movement of said bellow member.

* * * * *